US011708203B2

(12) United States Patent
Boulton et al.

(10) Patent No.: US 11,708,203 B2
(45) Date of Patent: Jul. 25, 2023

(54) PRODUCT PACKAGING

(71) Applicant: Conopeo, Inc., Englewood Cliffs, NJ (US)

(72) Inventors: Oliver James Boulton, Chester (GB); Nurani Dharmaraj Krishnaprakash Iyer, Kandivili West (IN)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 16/756,787

(22) PCT Filed: Oct. 23, 2018

(86) PCT No.: PCT/EP2018/079059
§ 371 (c)(1),
(2) Date: Apr. 16, 2020

(87) PCT Pub. No.: WO2019/081526
PCT Pub. Date: May 2, 2019

(65) Prior Publication Data

US 2020/0239211 A1 Jul. 30, 2020

(30) Foreign Application Priority Data

Oct. 26, 2017 (EP) ..... EP17198628

(51) Int. Cl.
*B65D 75/32* (2006.01)
*B65D 75/52* (2006.01)

(52) U.S. Cl.
CPC ..... *B65D 75/327* (2013.01); *B65D 75/527* (2013.01); *B65D 2575/565* (2013.01)

(58) Field of Classification Search
CPC .... B65D 75/327; B65D 25/22; B65D 75/367; B65D 75/42; B65D 2575/565; B65D 75/527
(Continued)

(56) References Cited

U.S. PATENT DOCUMENTS 4,970,845 A * 11/1990 Ausnit ..... B65B 43/42 206/820
5,685,420 A 11/1997 Martin et al.
(Continued)

FOREIGN PATENT DOCUMENTS

AU 2005219451 9/2005
CN 1096994 1/1995
(Continued)

OTHER PUBLICATIONS

Search Report and Written Opinion in EP17198628; dated Jun. 19, 2018.
(Continued)

*Primary Examiner* — Chun Hoi Cheung
(74) *Attorney, Agent, or Firm* — Gerard J. McGowan, Jr.

(57) ABSTRACT

A unit-dose packaging for a product comprising a chain of blister packs, the chain of blister packs being arranged in an alternating manner and having foldable regions between each blister pack in the chain of blister packs, characterised in that after use of the product, a chain of emptied blister packs forms a concertina fold, wherein all the blisters are of the same shape in the chain of blister packs such that the repeating units of the chain of blister packs are linked in such a way that their cavities fit into each other when stacking in an alternating way.

13 Claims, 3 Drawing Sheets

(58) Field of Classification Search
USPC ..... 206/820, 528, 530, 534.1, 534.2, 823
See application file for complete search history.

(56) References Cited

U.S. PATENT DOCUMENTS

| | | | | |
|---|---|---|---|---|
| 5,941,433 | A * | 8/1999 | Wilcher | B65D 75/56 224/191 |
| 6,253,920 | B1 | 7/2001 | Kallgren | |
| 6,527,138 | B2 * | 3/2003 | Pawlo | B65D 83/0409 221/26 |
| 8,144,326 | B2 | 3/2012 | Batchelor et al. | |
| 8,602,024 | B2 * | 12/2013 | Wachtel | A61M 15/0051 128/203.15 |
| 2002/0108963 | A1 | 8/2002 | Pawlo et al. | |
| 2004/0011693 | A1 * | 1/2004 | Prenger | B30B 11/027 206/531 |
| 2005/0191544 | A1 | 1/2005 | Casanova | |
| 2005/0043462 | A1 | 2/2005 | Yamada et al. | |
| 2006/0042988 | A1 * | 3/2006 | Hjalmarsson | B65D 75/327 206/539 |
| 2008/0302695 | A1 * | 12/2008 | Meeren | B65D 75/527 206/531 |
| 2009/0134054 | A1 * | 5/2009 | Lee | B65D 65/46 206/531 |
| 2009/0200182 | A1 * | 8/2009 | Post-Smith | B65D 43/162 206/5.1 |
| 2011/0121019 | A1 * | 5/2011 | Peer | G07F 17/0092 222/1 |
| 2012/0285858 | A1 * | 11/2012 | Peer | G16H 20/13 206/531 |
| 2013/0161230 | A1 * | 6/2013 | Haering | B65D 75/327 206/704 |
| 2017/0210530 | A1 | 7/2017 | Lyzenga et al. | |
| 2017/0224433 | A1 | 8/2017 | Doring et al. | |

FOREIGN PATENT DOCUMENTS

| | | |
|---|---|---|
| CN | 101541636 | 9/2009 |
| CN | 205906459 | 1/2017 |
| CN | 106573715 | 4/2017 |
| DE | 1904070 | 8/1970 |
| DE | 10044118 | 4/2002 |
| EP | 0062361 | 10/1982 |
| EP | 2607263 | 12/2011 |
| EP | 1957378 | 8/2012 |
| EP | 2627577 | 6/2016 |
| EP | 3180260 | 11/2018 |
| FR | 1127554 | 12/1956 |
| FR | 2610300 | 5/1988 |
| GB | 2096574 | 10/1982 |
| JP | S4822092 U | 3/1973 |
| JP | S53151873 | 11/1978 |
| JP | H0923917 | 1/1997 |
| JP | 2004262526 | 9/2004 |
| JP | 2006001574 | 1/2006 |
| JP | 2015007148 | 1/2015 |
| JP | 2017170122 | 9/2017 |
| WO | WO2005085558 | 9/2005 |
| WO | WO2007067054 | 6/2007 |

OTHER PUBLICATIONS

Search Report and Written Opinion in EP17198515 dated Mar. 3, 2018.
Search Report and Written Opinion in PCTEP2018079059; dated Jun. 12, 2019.
Search Report and Written Opinion in PCTEP201807960; dated Jun. 12, 2019.
Partial Search Report and Written Opinion in EP17198515; dated Mar. 19, 2018.
Partial Search Report and Written Opinion in EP17198628; dated Mar. 15, 2018.
Search Report and Written Opinion in EP17198640; dated Mar. 16, 2018.
IPRP2 in PCTEP2018079061; dated Jan. 28, 2020.
Search Report and Written Opinion in PCTEP2018079061; dated Feb. 14, 2019.
Co-pending U.S. Appl. No. 16/755,466, filed Apr. 10, 2020, entitled Product Packaging.

* cited by examiner

PRODUCT PACKAGING

CROSS-REFERENCE TO RELATED APPLICATIONS

This application claims priority to International Patent Application No. PCT/EP2018/079059, filed on Oct. 23, 2018, and European Patent Application No. 17198628.4, filed on Oct. 26, 2017, both of which are incorporated herein by reference in their entireties.

FIELD OF THE INVENTION

The present invention is in field of packaging; in particular it relates to packaging of FMCG products.

BACKGROUND OF THE INVENTION

The concept of sachet packs for FMCG products goes back a long time. The idea originated in the Asian markets as a way of making FMCG products available and affordable to the common man.

Sachets are great options for consumers who want to use a specific product but are against the idea of buying full-size packs due to reasons such as price constraints or consumer uncertainty for first-time buyers. Sachets are also known to help in driving consumption of products that do not have high penetration levels.

Sachet packaging, normally made of a thin film of plastic and aluminum in a sandwich laminate form, has captured many of the developing and under developed market segments and allowed the low-income communities to enjoy quality products such as shampoos, toothpastes, lotions, condiments, even ready-to-eat food and drinking water, which are not viable with normal bottle and container packaging.

While the sachets have brought better quality products to low-income communities, they have also become a waste challenge. Community waste volumes are projected to grow worldwide as adoption of these sachet products increases.

Because there is no economic incentive to collect used sachets that have been improperly dumped, they are not picked up whilst the plastic bottles are since they fetch a small amount of money if collected and returned.

Thus, waste sustainability is fast becoming an issue in countries in Asia, threatening to overrun landfills and create new ones from what are otherwise beautiful landscapes and endangering the water supply by contamination.

Biodegradable and recyclable sachets are available, but these are more expensive and affect the sensitive low-product price points which is the main justification for offering the product in sachet form in the first place.

Packaging with the film of plastic and aluminium is essential for sachets especially when used for packaging liquid products in order to avoid any leakage but are not recyclable or biodegradable.

Hence, a need remains for packaging that can be easily collected after use of the product and preferably made of cheap biodegradable or recyclable materials.

The art already provides teaching for easy and efficient folding of filled blister packs.

WO 2007/067054 relates to a blister pack for objects such as tablets, pills or capsultes, comprises a plurality of accomodation units (1) which are interconnected along lines of weakness (2). Each accomodation unit(1) is provided with a piercable base sheet (5) and a cap part (4) which is fixed to the base sheet (5), an accommodation space for accommodating an object (6) being formed between the base sheet (5) and the cap part (4) of each accommodation unit (1), characterised in that the blister pack comprises a plurality of connecting parts(3), each of which is connected by way of two respective Hines of weakness (2) to at least one accommodation unit (1) in each case.

DE10044118A1 relates to blister pack for tablets (1) has additional blisters (28) between those (13) which hold the tablets and projecting beyond them. Centering blister (2) project beyond both other sets of blisters. It also relates to a stack of blister packs with an exterior wrapping.

DE1904070A1 relates to synthetic film pack wherein recesses are immediately shaped as moulds for the still fluid chocolate, and a covering layer lying on and joined to the packing and of heat-sealable material, is provided. Preferably, it is heat-sealable paper, or a transparent aroma-proof material.

It is therefore an object of the present invention is to provide a packaging which can be easily collected after use of the product.

It is another object of the present invention to provide a packaging which encourages consumers to pick it up when seen littered.

It is yet another object of the present invention to provide a packaging model which eliminates the need of using plastic and aluminium.

It is yet another object of the present invention to provide a packaging model which uses recyclable and/or biodegradable material for packaging.

Surprisingly, it is found that a chain of emptied blister packs in the form of a compact concertina, wherein all the blisters (5) are of the same shape in a chain (1) such that the repeating units of the blister chain are linked in such a way that their cavities fit into each other when stacking in an alternating way, provide for compact waste collection.

SUMMARY OF THE INVENTION

Accordingly, in a first aspect, the present invention provides a unit-dose packaging for a product (P) comprising a chain of blister packs (1), said blister packs (2) being arranged in an alternating manner and having foldable regions (3) between the packs, characterised in that after use of the product (P), the chain of emptied blister packs form a concertina fold, wherein all the blisters (5) are of the same shape in the chain (1) such that the repeating units of the blister chain are linked in such a way that their cavities fit into each other when stacking in an alternating way.

In a second aspect, the invention provides a method of easy disposal of packaging material comprising a chain of blister packs (1) characterized in that after use of the product (P) contained in the blister, the chain of emptied blister packs (1) is folded to a compact concertina fold, wherein all the blister (5) are of the same shape in the chain (1) such that the repeating units of the blister chain are linked in such a way that their cavities fit into each other when stacking in an alternating way.

In a third aspect, the invention provides use of a chain of blister packs (1) according to the invention for packaging a FMCG product.

In a fourth aspect, the invention provides use of a chain of blister packs (1) according to the invention for packaging a home care, personal care or food product.

In the context of the present invention, the reference to "blister pack" typically means pre-formed packaging used for small consumer goods, foods, and for pharmaceuticals comprising a cavity or pocket (blister) made from a formable web.

In the context of the present invention, the reference to "concertina fold" typically means to fold, crush together or collapse in the manner of a concertina.

In the context of the present invention, the reference to "chain" typically means a series of blister packs connected one after another.

In the context of the present invention, the reference to "FMCG" typically means fast moving consumer goods.

In the context of the present invention, the reference to "line of weakness" typically means the line along which the blister packs can be separated and/or folded, preferably without the use of a tool, more preferably by hand.

In the context of the present invention, the reference to empty/emptied blister packs typically means the product in the blisters are used.

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description indicating amounts of material or conditions of reaction, physical properties of materials and/or use are to be understood as modified by the word "about".

Numerical ranges expressed in the format "from x to y" are understood to include x and y. When for a specific feature multiple preferred ranges are described in the format "from x to y", it is understood that all ranges combining the different endpoints are also contemplated.

DETAILED DESCRIPTION OF THE INVENTION

In a first aspect, the present invention relates to a unit-dose packaging for a product (P) comprising a chain of blister packs (1), said blister packs (2) being arranged in an alternating manner and having foldable regions (3) between the packs, characterized in that after use of the product (P), the chain of emptied blister packs form a concertina fold, wherein all the blisters (5) are of the same shape in the chain (1) such that the repeating units of the blister chain are linked in such a way that their cavities fit into each other when stacking in an alternating way.

Chain of Blister Packs

The chain of blister packs (1) according to the present invention can be a single chain of blister packs or multiple chains attached to each other. The chain is preferably a hanging chain.

The blister packs (2) of the present invention are arranged in an alternating manner wherein all the odd blisters face one side and the even blisters face the other side in the chain.

Each blister pack (2) is provided with a blister (5) and a backing.

The blisters (5) can be made of any known materials commercially available for forming web (blisters) in blister packs. The blisters (5) are preferably made of biodegradable or recyclable plastic. Suitable biodegradable or recyclable plastic include machine-direction orientation (MDO) films, in particular MDO films made from polyethylene, BOPP/PE films, BOPP/CPP films.

In a preferred embodiment, the plastic may be both biodegradable and recyclable.

The blisters (5) can be of any shape, but all the blisters (5) should be of the same shape in a chain (1) in order to form a compact concertina fold.

By compact concertina fold is meant that the repeating units of the blister chain are linked in such a way that their cavities fit into each other when stacking in an alternating way.

One such embodiment is demonstrated in FIG. 4.

Ideally the cavities fit into each other by having their walls at a slight angle, preferably between 1 to 60°, more preferably less than 45°, or even less than 30°.

Each blister pack may contain one or more blisters, preferably it contains at least one blister, but for the scope of the present invention blister packs containing two or more blisters are not excluded, for example a blister pack with two blisters, one blister with a shampoo and the other with a conditioner.

The backing can be made of any known materials commercially available for forming a backing in blister packs such as paper, aluminium or plastic. The backing is preferably made of a biodegradable or recyclable material. Suitable biodegradable or recyclable material include paper or cardboard.

In a preferred embodiment, the material may be both biodegradable and recyclable.

In one embodiment, the blister and the backing are made of the same material.

In another embodiment, the blisters are made of a material running continuously along the whole chain and the backing is made of a different material to seal the cavities on alternating sides.

In yet another embodiment, the backing is made of a material running continuously along the whole chain and the blisters are made of a different material to cover the product on alternating sides.

Foldable Regions

Between each blister pack (2), there is provided a foldable region (3) on the backing which is preferably weaker than the rest of the backing for easy folding between the packs.

The foldable region preferably comprises a line of weakness (4) along which the blister packs (2) can be separated and/or folded.

The line of weakness (4) can be continuous such as the use of a thinner or weaker material than the backing material that can be folded and/or torn. The line of weakness (4) can also be discontinuous such as scored or perforated.

In preferred embodiments, the foldable region (3) comprises a groove (6) along which the blister packs (2) can be folded. The groove may further comprise the line of weakness (4). The character of the line of weakness (4) may be according to the description of the paragraph immediately above. The groove is found particularly helpful to guide consumer to fold as well as control the manner of folding. It also ensures the cavities fold inside one another. The grooves may all be protruding in the same direction, or they may be alternating.

The chain of blister packs (1) can form a concertina fold before and after the use of the product (P) but the angle (a)

between the packs vary. After the use of the product (P), the cavities fit into each other forming a compact concertina fold.

When the chain is in a concertina fold before the use of the product (P), the blister packs (2) are at an angle of 40° to 180° (a), preferably at least 50°, more preferably at least 60°, still more preferably at least 70°, even more preferably at least 80°, but typically not more than 160°, preferably not more than 140°, more preferably not more than 120°, still more preferably not more than 100°, even more preferably not more than 90° at the foldable region (3).

When the chain is in a compact concertina fold after the use of the product (P), the blister packs (2) are at an angle of 0° to 25° (a), preferably at least 2.5°, more preferably at least 5° more preferably at least 8°, still more preferably at least 10°, even more preferably at least 13° but typically not more than 23°, preferably not more than 20°, more preferably not more than 18°, still more preferably not more than 15° at the foldable region (3).

Product

The product (P) according to the present invention is preferably in solid or a semi solid format such as a gel to avoid any product wastage during use.

The product (P) is typically a dehydrated product that may be dissolved using a solvent before use.

The product (P) comprises less than 50% of water, preferably less than 45%, more preferably less than 40%, still more preferably less than 35%, even more preferably less than 30%, or even less than 25% or even less than 20% or even less than 15% or even less than 10% by weight of the total product composition.

The product (P) of the present invention is preferably a FMCG product; in particular, a personal care, home care or food product. Home care products may be detergent tablets (such as laundry or dishwashing detergents), cleaning composition tablets, water purification compositions. Food products may include, bouillon cubes, food concentrates, instant soups or sauces, chewing gum, instant dressings. Personal care products may include detergent compositions such shampoo, conditioner, soap (such as hand wash, face wash or body wash/shower gel), mouthwash, intimate wash, shaving gel.

Preferably the product (P) is a personal care product, which is a shampoo, conditioner or body wash/shower gel in dehydrated format.

Each blister pack may contain one or more products in a blister, preferably it contains at least one product, but for the scope of the present invention blisters containing two or more products are not excluded, for example a blister pack comprising a blister with a shampoo and a conditioner. In case of more than one product, said products may be same or different.

In a second aspect, the present invention relates to a method of easy disposal of packaging material comprising a chain of blister packs (1) characterized in that after use of the product (P) contained in the blister, the chain of emptied blister packs (1) is folded to a compact concertina fold, wherein all the blister (5) are of the same shape in the chain (1) such that the repeating units of the blister chain are linked in such a way that their cavities fit into each other when stacking in an alternating way.

After the use of the product (P), the chain of opened blister packs can be stacked one above the other in a compact manner making it convenient for disposal or collection.

In a third aspect, the present invention relates to use of a chain of blister packs (1) according to the invention for packaging a FMCG product.

In a fourth aspect, the present invention relates to use of a chain of blister packs (1) according to the invention for packaging a home care, personal care or food product.

Figure 1A:
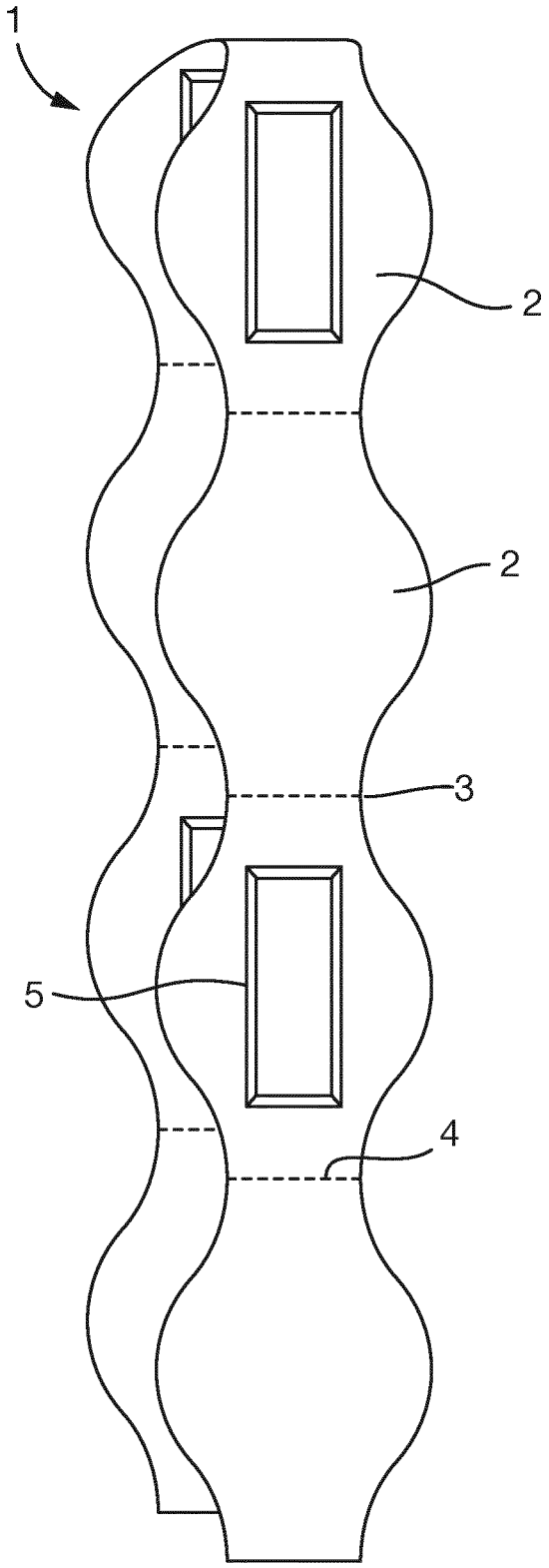
FIG. 1A is a perspective view of a hanging chain of blister packs arranged in an alternating manner.
Figure 1B:
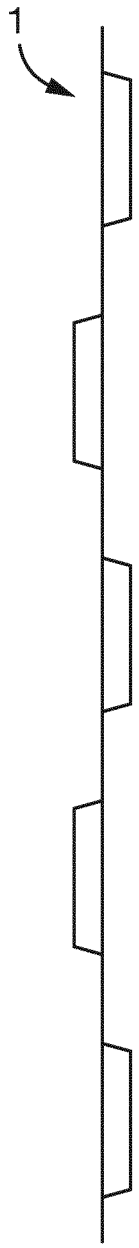
FIG. 1B is a side view of a hanging chain of blister packs arranged in an alternating manner.
Figure 2:
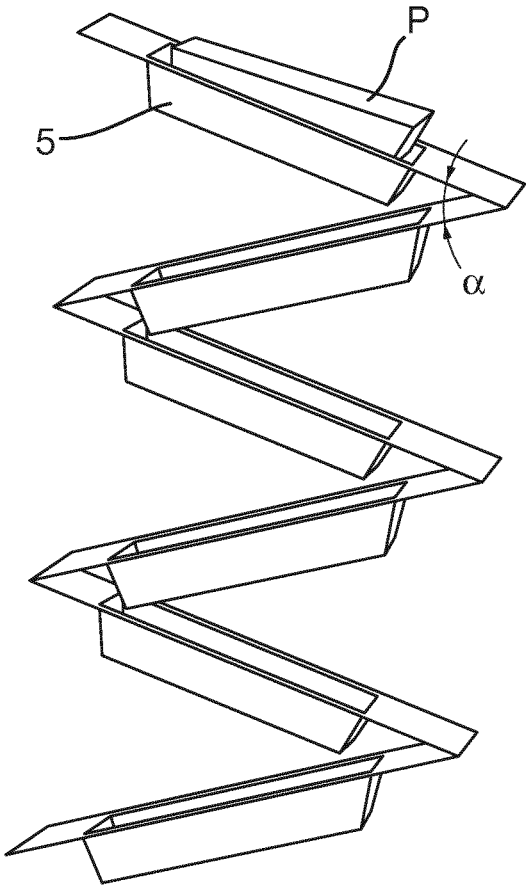
FIG. 2 is a side view of a chain of unused blister packs in a concertina fold.
Figure 3:
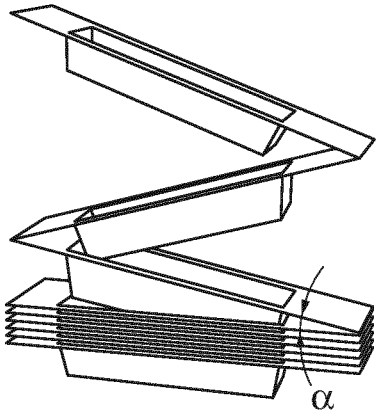
FIG. 3 is a side view of a chain of used blister packs falling into a compact concertina fold.
Figure 4:
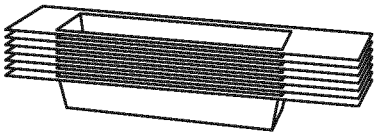
FIG. 4 is a side view of a chain of used blister packs in a compact concertina.
Figure 5:
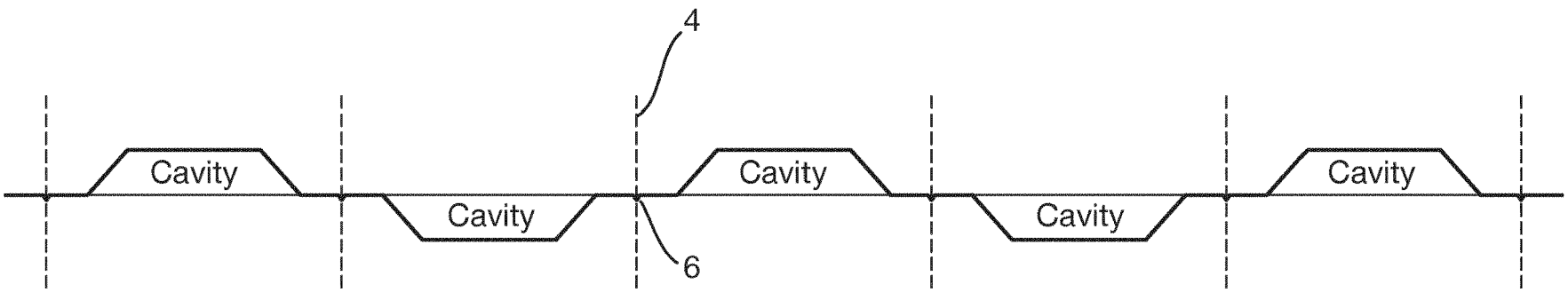
FIG. 5 is a side view of a chain of blister packs arranged in an alternating manner with lines of weakness and grooves. It is clear that after the use of product (P), the packs can be folded into a compact concertina form with an angle of 0° to 25° (a) at the foldable region (3).

What is claimed is:

1. An easy disposal unit-dose packaging for a product wherein after use of the product contained in the packaging the package can be folded to a compact concertina fold, the packaging comprising a chain of blister packs, the chain of blister packs being arranged in an alternating manner and having foldable regions between each blister pack in the chain of blister packs, characterised in that after use of the product, a chain of emptied blister packs can form the concertina fold, wherein all the blisters are of the same shape in the chain of blister packs such that the repeating units of the blister chain of blister packs are linked in such a way that their cavities fit into each other when stacking in an alternating way.

2. The easy disposal unit-dose packaging of claim 1 in combination with a water-containing product, wherein the product comprises less than 50% of water by weight of a total product composition of the product.

3. The easy disposal unit-dose packaging of claim 1 in combination with a product, wherein the chain of blister packs are at an angle of 40.degree. to 180.degree., inclusive, at the foldable region in the concertina fold before the use of the product.

4. The easy disposal unit-dose packaging of claim 1, wherein the chain of blister packs are at an angle of 0.degree. to 25.degree., inclusive, at the foldable region in the compact concertina fold after the emptying of the product.

5. The easy disposal unit-dose packaging of claim wherein the foldable region comprises a line of weakness.

6. The easy disposal unit-dose packaging of claim 1, wherein the chain of blister packs are made of at least one of: a biodegradable plastic or a recyclable plastic.

7. The easy disposal unit-dose packaging of claim 1, wherein the blister pack has a backing made of at least one of: a biodegradable material or a recyclable material.

8. The easy disposal unit-dose packaging of claim 1, wherein the chain of blister packs is a hanging chain.

9. The easy disposal unit-dose packaging of claim 3, wherein the product is a fast moving consumer good (FMCG) product.

10. The easy disposal unit-dose packaging of claim 9, wherein the product is at least one of: a personal care, home care, or food product.

11. A method of easy disposal of packaging material comprising a chain of blister packs characterized in that after use of a product contained in a blister in the chain of blister packs, a chain of emptied blister packs is folded to a compact concertina fold, wherein each blister in the chain of blister packs is of the same shape such that the repeating units of the chain of blister packs are linked in such a way that their cavities fit into each other when stacking in an alternating way.

12. The method according to claim 11 wherein the blister packs contain a fast moving consumer good (FMCG) product prior to emptying.

13. The method according to claim 11 wherein the blister packs contain a home care, personal care, or food product prior to emptying.

* * * * *